US005353458A

United States Patent [19]

Singler

[11] Patent Number: 5,353,458

[45] Date of Patent: Oct. 11, 1994

[54] METHOD FOR TRANSPORTING KNIT FABRIC WEB BETWEEN THE SQUEEZE ROLLERS OF A PADDING DEVICE AND A TAKE UP ROLL

[75] Inventor: Hanspeter Singler, Monchen-Gladbach, Fed. Rep. of Germany

[73] Assignee: A. Monforts GmbH & Co., Moenchengladbach, Fed. Rep. of Germany

[21] Appl. No.: 821,222

[22] Filed: Jan. 16, 1992

[30] Foreign Application Priority Data

Jan. 18, 1991 [DE] Fed. Rep. of Germany ..... 4101357

[51] Int. Cl.[5] ..... D06B 3/18

[52] U.S. Cl. ..... 8/151; 68/22 R

[58] Field of Search ..... 8/151; 68/22 R; 242/65

[56] References Cited

U.S. PATENT DOCUMENTS

| | | | |
|---|---|---|---|
| 739,580 | 9/1903 | Boral et al. | 68/22 R |
| 1,642,360 | 9/1927 | Crowell | 8/151 X |
| 2,057,822 | 10/1936 | Dreghsel | 8/151 X |
| 2,644,490 | 7/1953 | Harden | 242/65 X |
| 3,643,474 | 2/1972 | Schiffer | 68/22 R X |

FOREIGN PATENT DOCUMENTS

| | | |
|---|---|---|
| 23896 | 4/1906 | Fed. Rep. of Germany . |
| 1950056 | 9/1966 | Fed. Rep. of Germany . |
| 3006753 | 10/1980 | Fed. Rep. of Germany . |
| 3120042A1 | 12/1982 | Fed. Rep. of Germany . |
| 1028905 | 5/1966 | United Kingdom . |

*Primary Examiner*—Philiip R. Coe

*Attorney, Agent, or Firm*—Shefte, Pinckney & Sawyer

[57] ABSTRACT

A method and an apparatus for supporting a traveling web of knit fabric. The apparatus includes an uneven number of intermediate support rollers for supporting the knit fabric web as it travels between a padding device and a take up roll. The knit web fabric passes through a pair of squeeze rollers following pad dyeing thereof at the padding device and travels in trained relation in serpentine manner about the intermediate support rollers between the pair of squeeze rollers and the take up roll. In addition to supporting the knit fabric web to prevent undesired stretching or elongation of the still damp web as it travels from the padding device, the apparatus insures that the knit fabric web is disposed on the take up roll in such a manner that the edges, to the extent they are susceptible to curling, tend to curl in a radially inward direction with respect to the take up roll, whereby succeeding lengths of the knit fabric web taken up on the take up roll compress and straighten the curling edges. A support member is pivotally mounted to the frame of the padding device and the intermediate support rollers are each supported in pendant manner from the support member, thereby providing the apparatus with the flexibility to support the knit fabric web as it travels between the padding device and the take up rolls mounted at different heights with respect to the padding device.

3 Claims, 1 Drawing Sheet

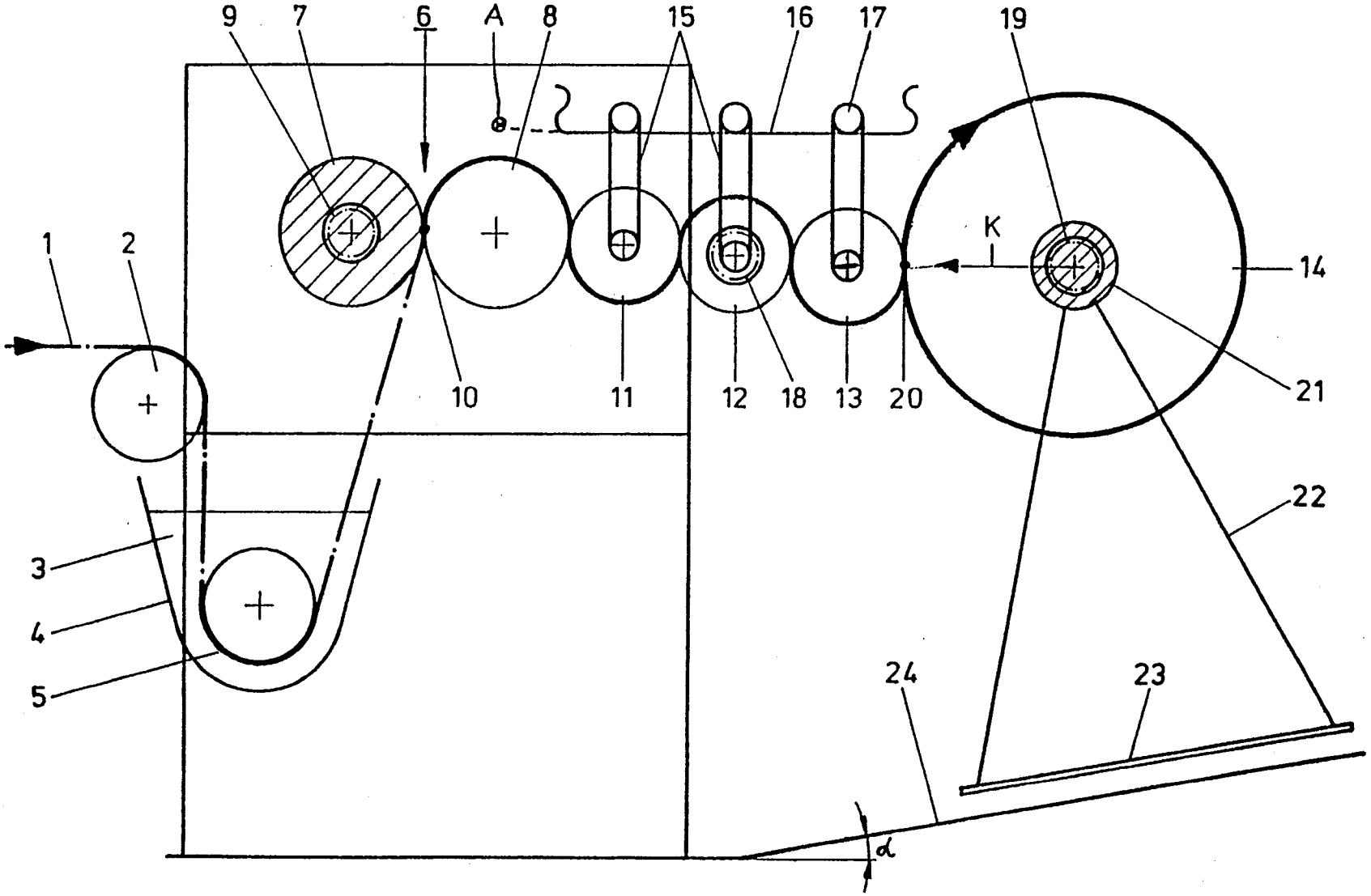
1
2
3
4
5
6
7
8
9
10
11
12
13
14
15
16
17
18
19
20
21
22
23
24
A
K
α

METHOD FOR TRANSPORTING KNIT FABRIC WEB BETWEEN THE SQUEEZE ROLLERS OF A PADDING DEVICE AND A TAKE UP ROLL

BACKGROUND OF THE INVENTION

The present invention relates to a method for supporting a traveling web of knit fabric as the web travels between a padding device and a take up roll on which the knit fabric web is taken up.

During the production of knit fabric of the type used in hosiery, it is known to subject the knit fabric to a pad dyeing process in which a web of the knit fabric is submersed in the pad bath of a padding device and is thereafter traveled through the nip formed between a pair of squeeze rollers for removal of excess padding from the knit fabric web. After travel through the nip of the squeeze rollers, the still damp knit fabric web is typically taken up on a take up roll and the taken up knit fabric web remains on the take up roll for a predetermined time selected for the particular padding substance which has been applied to the knit fabric and the type of material of which the knit fabric is composed. It is customary to subject the roll of taken up knit fabric to a vibrating action to thereby minimize the formation of undesired pools of liquid on the fabric.

The edges of the knit fabric web have a tendency to curl and, to counteract this curling tendency, it is known to provide appropriate devices such as, for example, fabric spreaders for maintaining the edges of the knit fabric web in a generally uncurled state prior to the travel of the knit fabric web into the padding device, and, additionally, during travel of the web between the pad bath and the pair of squeeze rollers. The curling tendency of the knit fabric web likewise occurs as the knit fabric web travels beyond the pair of squeeze rollers to the take up roll. Accordingly, it is known to position the take up roll relatively closely adjacent the pair of squeeze rollers so as to minimize the extent of travel of the knit fabric web between the pair of squeeze rollers and the take up roll and thereby minimize the extent to which the edges of the knit fabric web travel in unsupported manner. British Patent Specification 1,028,905 discloses an arrangement in which a perforated stainless steel drum, which acts as a take up roll, is positioned closely adjacent the respective one of the padding mangle rolls over which the knitted fabric is traveled following its passage through the nip formed between the pair of mangle rolls.

As the knit fabric web is taken up on the take up roll, the diameter of the already taken up knit fabric web on the take up roll correspondingly increases and so provisions must be made for continuously adjusting the spacing between the axis of the take up roll and the pair of squeeze rollers to avoid a situation in which the knit fabric web binds during its passage therebetween or is subjected to an undesired compressive force. To avoid these problems, it is known to space the take up roll from the pair of squeeze rollers but this solution brings with it corresponding disadvantages. For example, appropriate provisions must be made for counteracting the tendency of the edges of the knit fabric web to curl such as, for example, by providing additional fabric spreaders for maintaining the web edges in an uncurled condition as the knit fabric web travels between the pair of squeeze rollers and the take up roll. Accordingly, the need still exists for a method for facilitating the efficient take up of a knit fabric web on a take up roll while minimizing undesired curling of the edges of the knit fabric web.

SUMMARY OF THE INVENTION

The present invention provides a method for facilitating the efficient take up of a knit fabric web on a take up roll. The method minimizes undesired curling of the edges of the knit fabric web during take up by supporting the web substantially during its entire travel from the squeeze rollers to the take up roll on an uneven number of intermediate support rollers.

The method of the present invention is best illustrated by reference to the preferred apparatus for practicing it. Briefly described, the preferred apparatus supports the web during its travel between the pair of squeeze rollers and the take up roll in an assembly for pad dyeing of knit fabric. The assembly has a padding device for applying liquor to a traveling web of knit fabric, a pair of squeeze rollers wherein forming a nip therebetween, and a take up roll, the pair of squeeze rollers are used for squeezing liquor from the web as the web travels through the nip from the padding device and the take up roll is used for taking up the still damp web of knit fabric thereon following travel of the web through the nip. The apparatus includes an uneven number of intermediate support rollers each having an axial extent at least equal to the width extent of the web of knit fabric transverse to the direction of travel of the web. Also, the apparatus includes means for rotatably supporting the intermediate support rollers intermediate the pair of squeeze rollers and the take up roll for travel of the web sequentially in trained relation about the intermediate support rollers during passage of the web from the pair of squeeze rollers to the take up roll.

According to one aspect of the preferred apparatus, the rotatably supporting means supports the intermediate support rollers relative to one another such that the web travels in serpentine manner about the intermediate support rollers with each intermediate support roller rotating in response to movement of the web thereover in a direction of rotation opposite to the direction of rotation of the adjacent preceding intermediate support roller. In a further feature of the one aspect of the preferred apparatus, the web travels in trained relation over one of the pair of squeeze rollers following travel of the web through the nip and the means for rotatably supporting the intermediate support rollers includes means for mounting the intermediate support rollers at spacings from one another such that there is substantially no unsupported extent of the web between adjacent intermediate support rollers.

According to another aspect of the preferred apparatus, the travel of the web in trained relation over the intermediate support rollers effects rotation of the intermediate support rollers and further comprising means for selectively supplementing the rotation of at least one intermediate support roller.

According to an additional aspect of the preferred apparatus, each of the first, second and third intermediate support rollers has an axis and the means for rotatably supporting the intermediate support rollers supports the intermediate support rollers with their axes generally co-planar. In a further feature of the addtional aspect of the present invention, the means for rotatably supporting the intermediate rollers includes a support member pivotally mounted for pivoting about a pivot axis parallel to the axes of the intermediate support rollers and a plurality of suspension arms supporting the intermediate support rollers in pendant relation from the support member. Each intermediate support roller is rotatably mounted to one end of a respective suspension arm and each suspension arm is freely rotatably mounted to the support member, whereby the axes of the intermediate support rollers are maintained in generally co-planar relation with one another throughout a range of pivotal movement of the support member.

According to a further additional aspect of the preferred apparatus, the number of intermediate support rollers is three or five.

In a different aspect of the present invention. The method is practiced with an apparatus for an assembly for pad dyeing of knit fabric, the assembly having a padding device for applying liquor to a traveling web of knit fabric in a pad liquor applying process, a pair of squeeze rollers forming a nip therebetween, and a take up roll. The pair of squeeze rollers is provided for squeezing liquor from the web as the web travels through the nip and the take up roll is provided for taking up the still damp web of knit fabric following travel of the web through the nip from the pad dyeing device, the web has a directional curl bias such that the edges of the web, to the extent that they are susceptible to curling, tend to curl in the same predetermined direction relative to one surface of the web, and the web traveling in trained relation around a selected one of the pair of squeeze rollers following travel of the web through the nip such that the wet edges, when they curl in the predetermined direction of curl, curl in a radially inward direction relative to the selected one squeeze roller. The apparatus is operable to support the web during its travel between the selected one squeeze roller and the take up roll, and the apparatus is operable to orient the web for travel thereof onto the take up roll in an orientation in which the web edges, if they curl in response to the directional curl bias, will curl in a radially inward direction relative to the take up roll. The apparatus includes at least one roller which has an axial extent at least equal to the width of the web, the at least one roller is disposed intermediately of the selected one squeeze roller and the take up roll for travel of the web thereover in trained relation.

As revealed, the preset invention relates to a method for pad batch handling of knit fabric, comprising transporting a web of knit fabric through a pad liquor bath, the web having a directional curl bias such that the edges of the web, to the extent that they are susceptible to curling, tend to curl in the same predetermined direction relative to one surface of the web and further transporting the web of knit fabric through a nip formed by a pair of squeeze rollers to effect squeezing of excess pad liquor from the web. The web is traveled in trained relation around a selected one of the pair of squeeze rollers following travel of the web through the nip such that the wet edges, when they curl in the predetermined direction of curl, curl in a radially inward direction relative to the selected one squeeze roller.

The method also includes traveling the web of knit fabric about at least one intermediate support roller in a trained relation thereto and taking up the traveling web onto a take up roll following its travel about the at least one intermediate support roller in an orientation such that the web edges, if they curl in response to the directional curl bias, will curl in a radially inward direction relative to the take up roll.

DETAILED DESCRIPTION OF THE PREFERRED EMBODIMENT

The preferred method of practicing the present invention involves the use of a preferred apparatus which is a part of an assembly for pad dyeing of a traveling web of knit fabric, as seen in the sole FIGURE of the drawings.

The pad dyeing assembly also includes a conventional padding device for applying pad liquor to the knit fabric web 1 and a take up roll 14 for taking up the knit fabric web 1. The preferred apparatus, or web supporting apparatus, is disposed intermediate the padding device and the take up roll 14 for supporting the knit fabric web 1 during its travel between the padding device and the take up roll 14.

The padding device for applying pad liquor to the knit fabric web 1 is of conventional structure and operation so further details thereof are not provided herein except reference is made to the sole FIGURE of the drawings in which it can be seen that the padding device comprises a feed guide roller 2, a trough 4 having a pad liquor bath 3 therein, a dip roller 5 and a squeeze roller assembly 6 having a pair of squeeze rollers 7,8. The pair of squeeze rollers 7,8 form a nip 10 therebetween and at least one of the squeeze rollers such as, for example, the squeeze roller 7, is operatively connected to a drive mechanism 9 for driving rotation of the squeeze roller.

As described in more detail below, the drive mechanism 9 is preferably associated with the respective squeeze roller 7,8 different than the one squeeze roller over which the knit fabric web 1 travels following its passage through the nip 10. The drive mechanism 9 is accordingly operatively connected to the squeeze roller 7 since the knit fabric web 1 travels over the other squeezing roller 8 following its passage through the nip 10.

The web supporting apparatus includes a first intermediate support roller 11, a second intermediate support roller 12, and a third intermediate support roller 13. Each of the intermediate support rollers 11–13 has an axial extent at least equal to the width extent of the knit fabric web 1 as measured transversely to its direction of travel. Each of the intermediate support rollers 11–13 is freely rotatably mounted to one end of an associated suspension arm 15. The other end of each suspension arm 15 is freely pivotally mounted by a pivot 17 to a common mounting support 16. The common mounting support 16 is pivotally mounted to a frame at a pivot location A.

The take up roll 14 includes a core 21 rotatably supported at the apex of a triangular frame 22 having a base 23. The core 21 is operatively connected to a conventional roll drive mechanism 19 which is operable to drive the rotation of the core 21 at a proportionally decreasing rate of rotation in correspondence with the increase in the diameter of a roll of the knit fabric 1 taken up on the core 21 such that the circumferential speed of the knit fabric 1 being taken up on the take up roll 14 is substantially constant as the diameter D of the take up roll 14 continuously increases. The base 23 of the triangular frame 22 is supported on an inclined track 24 for sliding downward movement therealong. The inclined track 24 is at an angle of inclination alpha with respect to the horizontal and slopes downwardly in the direction from the take up roll 14 toward the padding device.

The travel and handling of the knit fabric web 1 will now be described. The traveling movement of the knit fabric web 1 is produced by the continuous rotation of the take up roll 14. The knit fabric web 1 travels from a supply roll (not shown) or another web handling location over the feed guide roll 2, the knit fabric web 1 traveling downwardly following its trained travel around the feed guide roller 2 into the pad liquor bath 3 in the pad liquor trough 4. The knit fabric web 1 is completely submersed in the pad liquor bath 3 as it travels in trained relation around the dip roller 5 and the knit fabric web 1 emerges from the pad liquor bath 3 in a saturated state as it travels from the dip roller 5 to the nip 10.

The driving rotation of the one squeeze roller 7 drives the saturated knit fabric web 1 through the nip 10 and the knit fabric web 1 travels in trained relation about the other squeeze roller 8 immediately following its passage through the nip 10 in which excess moisture is squeezed from the knit fabric web 1. Due to factors such as the saturation of the knit fabric web 1 and the inherent nature of the web itself, the knit fabric web 1 typically exhibits a directional curl bias in which the edges of the web tend to curl in the same predetermined direction relative to one surface of the web. For example, the pair of opposed lateral edges of the knit fabric web 1 may tend to curl inwardly relative to the respective surface of the web facing to the right-hand side of the sole FIGURE of the drawing. Preferably, the knit fabric web 1 is trained around the respective squeeze roller 8 immediately following its passage through the nip 10 such that the web edges, when they curl in the predetermined direction of curl, curl in a radially inward direction relative to the respective squeeze roller 8. For example, in the event that the knit fabric web 1 has a directional curl bias such that the edges of the web tend to curl in the direction toward its right-hand facing surface, the knit fabric web 1 is preferably traveled in trained relation about the squeeze roller 8 immediately following its passage through the nip 10 so that the web edges curl in a radially inward direction relative to the squeeze roller 8 during trained travel of the knit fabric web 1 thereover.

Since it is desirable that the knit fabric web 1 be trained around both the squeeze roller 8 and the take up roll 14 in a manner in which its edges tend to curl in a radially inward direction with respect to the squeeze roller and the take up roll, the number of intermediate support rollers positioned between the squeeze roller 8 and the take up roll 14 must be an odd number, such as 3 or 5. The odd number arrangement of the intermediate support rollers 14 insures that the knit fabric web 1 travels in an S-shaped, meandering travel path between the squeeze roller 8 and the take up roll 14.

Following its travel over the squeeze roller 8, the knit fabric web 1 immediately travels in trained relation around the first intermediate support roller 11. Since the knit fabric web 1 still retains some moisture even after its passage through the nip 10, factors such as the increased weight of the knit fabric web 1 would cause undesired sagging and stretching of the knit fabric web if the knit fabric web were not adequately supported during its passage from the squeeze roller assembly 6 onto the take up roll 14. However, the web supporting apparatus advantageously guides and supports the knit fabric web 1 during its travel between the squeeze roller assembly 6 and the take up roll 14. To minimize any unsupported travel of the knit fabric web 1 between the squeeze roller assembly 6 and the take up roll 14, the intermediate support rollers 11–13 are mounted by their associated suspension arms 15 from the common mounting support 16 such that the knit fabric web 1 travels substantially immediately from one intermediate support roller onto the adjacent intermediate support roller. Since the knit fabric 1 is substantially completely supported on a intermediate support roller surface during its passage between the squeeze roller assembly 6 and the take up roll 14, the tendency of the lateral edges of the web to curl under the influence of the directional curl bias is counteracted.

The knit fabric web 1 is sequentially traveled around the intermediate support rollers 11–13 such that the rotation of each respective intermediate support roller resulting from frictional engagement thereof by the knit fabric web 1 traveling thereover is opposite to the rotation of the adjacent preceding intermediate support roller or rollers. For example, the knit fabric web 1 travels about the first intermediate support roller 11 such that the frictional engagement of the intermediate support roller by the knit fabric web causes rotation of the first intermediate support roller in a counterclockwise manner. Thereafter, the knit fabric web 1 travels in trained relation about the second intermediate support roller 12 in such a manner that the frictional engagement of the second intermediate support roller by the knit fabric web causes rotation of the second intermediate support roller in a clockwise direction. Upon exiting its trained travel about the second intermediate support roller 12, the knit fabric web 1 travels in trained relation about the third intermediate support roller 13 such that frictional engagement between the knit fabric web and the third intermediate support roller causes rotation of the third intermediate support roller in a counterclockwise direction.

The knit fabric web 1 travels from the third intermediate support roller 13 onto the take up roll 14 at a nip 20 formed between the third intermediate support roller and the take up roll.

Preferably, the take up roll 14 is driven in a direction of rotation such that the lateral edges of the knit fabric web 1, to the extent that they tend to curl in response to the directional curl bias, will curl in a radially inward direction relative to the take up roll 14. The succeeding portions of the knit fabric web 1 taken up on the take up roll 14 overlay and frictionally engage the already taken up portions of the knit fabric web 1 and thereby inhibit the pendency of the knit fabric web to curl or to contract in a lateral direction.

As the knit fabric web 1 is taken up on the take up roll 14, the diameter D of the take up roll correspondingly increases and the drive mechanism 19 correspondingly adjusts the rate of rotation of the core 21 to insure that the circumferential speed of the knit fabric web 1 is maintained substantially constant. Also, as the diameter D of the take up roll 14 continuously increases, the take up roll 14 applies a force K in the direction shown by the arrow in the sole FIGURE of the drawings through the knit fabric web 1 against the third intermediate support roller 13 and, sequentially, through the second intermediate support roller 12, the first intermediate support roller 11 and against the squeeze roller 8. The magnitude of the force K applied by the take up roll 14 corresponds to the angle of inclination alpha of the inclined track 24 on which the base 23 is supported. Since the inclined track 24 is inclined in the direction from the take up roll 14 toward the padding device, the force of gravity urges the take up roll 14 to slide downwardly along the inclined track 24, thereby pressing against the third intermediate support roller 13 with the force K. Additionally, as the diameter of the take up roll 14 increases, the base 23 of the triangular frame 22 slides upwardly along the inclined track 24 whereby the nip 20 remains in a fixed location throughout the taking up of the knit fabric web 1 onto the take up roll 14. Since the magnitude of the force K increases in correspondence with the increasing mass of the take up roll 14, the compressive force exerted on the knit fabric web 1 at the nip 20 increases correspondingly with the take up of the knit fabric web on the take up roll 14 and this tends to counteract the increasing moment arm force applied to the knit fabric web 1 being taken up on the take up roll 14.

The web supporting apparatus advantageously provides the capability to automatically adapt to variations in the height at which the core 21 of the take up roll 14 is supported. Since each of the intermediate support rollers 11–13 is freely rotatably mounted to its associated suspension arm 15 and since each of these suspension arms 15 is freely pivotally mounted to the common mounting support 16, each of the suspension arms 15 remains essentially vertical throughout the range of pivoting movement of the common mounting support 16 about the pivot A. Since each of these suspension arms 15 are preferably of identical length, the axes of the intermediate support rollers 11–13 are maintained in co-planar relation with one another throughout the range of pivotal movement of the common support member 16 (the plane on which the axes of the intermediate support rollers 11–13 are co-planar is a plane parallel to the longitudinal extent of the common mounting support 16).

The pivot A of the common mounting support 16 lies on the vertical plane defined by the axis of the squeeze roller 8 and the pivot A is disposed relatively closely adjacent to, and above, the squeeze roller 8. Since the distance between the axis of the squeeze roller 8 and the pivot A is relatively small in relation to the distance between the axis of the squeeze roller 8 and the axis of the take up roll 14, the disposition of the pivot A at its location above the squeeze roller 8 provides substantially the same advantage as if the pivot A were coincident with the axis of the squeeze roller 8. By pivoting of the common mounting support 16 about the pivot A, the axes of the intermediate support rollers 11–13 can be disposed on the line passing through the axis of the squeeze roller 8 and the axis of the take up roll 14 throughout a range of differences in height between the squeeze roller 8 and the take up roll 14.

Although the web supporting apparatus has been described as comprising intermediate support rollers 11–13 which are freely rotatable, another aspect of the preferred apparatus may also include a drive mechanism 18 can be operatively connected to one or more of the intermediate support rollers 11–13 for driving rotation of the intermediate support roller. The intermediate support roller can then be drivingly rotated to supplement any rotation of the intermediate support roller which is caused by torque or moment arm forces exerted on the intermediate support roller by the knit fabric web 1 traveling thereover.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for pad batch handling a web of knit fabric, comprising:

transporting the web of knit fabric through a pad liquor bath, the web having a directional curl bias such that the edges of the web, to the extent that they are susceptible to curling, tend to curl in the same predetermined direction relative to one surface of the web once wetted in the bath;

further transporting the web of knit fabric from the bath and then through a nip formed by a pair of squeeze rollers located at a distance from the bath to effect squeezing of excess pad liquor from the web;

traveling the web of knit fabric in a trained relation around a selected one of the pair of squeeze rollers following travel of the web through the nip;

orienting the web of knit fabric such that any tendency of the web edges to curl will be in a radially inward direction relative to the selected one of the pair of squeeze rollers;

further traveling the web of knit fabric about at least one intermediate support roller in a trained relation thereto;

maintaining substantially constant peripheral contact between the web of knit fabric and the at least one intermediate support roller;

taking up the traveling web onto a take up roll while maintaining the take up roll in substantially constant peripheral contact with the at least one intermediate support roller; and orienting the web of knit fabric such that any tendency of the web edges to curl will be in a radially inward direction relative to the take up roll.

2. A method according to claim 1 and further comprising the step of selectively supplementing the rotation of at least one of the intermediate support rollers which is caused by the travel of the web of knit fabric in trained relation over the at least one intermediate support roller.

3. A method according to claim 1 and further comprising orienting a take up roll on an inclined surface to slide downwardly opposite to the direction of travel of the web of knit fabric and the step of taking up the traveling web onto a take up roll includes taking up the traveling web on the downwardly sliding take up roll.

* * * * *

UNITED STATES PATENT AND TRADEMARK OFFICE

CERTIFICATE OF CORRECTION

PATENT NO. : 5,353,458
APPLICATION NO. : 07/821222
DATED : October 11, 1994
INVENTOR(S) : Hanspeter Singler et al.

It is certified that error appears in the above-identified patent and that said Letters Patent is hereby corrected as shown below:

The Reexamination Certificate issued on April 8, 1997, which is attached to utility patent no. 5,353,458, should be deleted. No reexamination certificate was granted for this patent.

Signed and Sealed this

First Day of May, 2007

JON W. DUDAS
*Director of the United States Patent and Trademark Office*

US005353458B1

REEXAMINATION CERTIFICATE (3172nd)

United States Patent [19] [11] B1 5,353,458

Westfall [45] Certificate Issued Apr. 8, 1997

[54] CURL SPRING SHOE BASED WINDOW BALANCE SYSTEM

[75] Inventor: Norman R. Westfall, Rochester, N.Y.

[73] Assignee: Caldwell Manufacturing Company, Rochester, N.Y.

Reexamination Request:
No. 90/004,293, Jun. 28, 1996

Reexamination Certificate for:

| | |
|---|---|
| Patent No.: | **5,353,458** |
| Issued: | **Oct. 11, 1994** |
| Appl. No.: | **40,457** |
| Filed: | **Apr. 1, 1993** |

[51] Int. Cl.[6] ..... E05D 13/00; E05D 15/22

[52] U.S. Cl. ..... 49/446; 49/176; 49/181; 16/197

[58] Field of Search ..... 49/446, 445, 181, 49/176; 16/197

[56] References Cited

U.S. PATENT DOCUMENTS

| | | |
|---|---|---|
| 1,226,843 | 5/1917 | Arvine . |
| 1,965,478 | 7/1934 | Smith . |
| 2,067,164 | 1/1937 | Smith . |
| 2,609,193 | 9/1952 | Foster . |
| 2,684,499 | 7/1954 | Lewis . |
| 2,732,594 | 1/1956 | Adams et al. . |
| 2,817,872 | 12/1957 | Foster . |
| 3,820,193 | 6/1974 | Foster . |
| 4,227,345 | 10/1980 | Durham, Jr. . |
| 4,363,190 | 12/1982 | Anderson . |
| 4,953,258 | 9/1990 | Mennuto . |
| 4,958,462 | 9/1990 | Cross . |
| 5,157,808 | 10/1992 | Sterner, Jr. . |
| 5,210,976 | 5/1993 | Cripps . |

*Primary Examiner*—Kenneth J. Dorner

[57] ABSTRACT

A window balance system for a tilt sash uses a pair of constant force curl springs having curled convolutions carried by sash shoes and free end regions mounted in sash shoe channels above the region of travel of the shoes. The recurl tendancy of the springs imparts a lift to the curled spring convolutions, and the shoes transmit the lift to the sash. The springs recurl into the convolutions as the shoes rise and uncurl from the shoes into the shoe channels when the shoes move downward, and neither movement requires the springs to slide frictionally within the shoe channels. Each shoe is preferably formed of two identical halves that are assembled to trap the curl spring along with a cam that locks the shoe when the sash tilts.

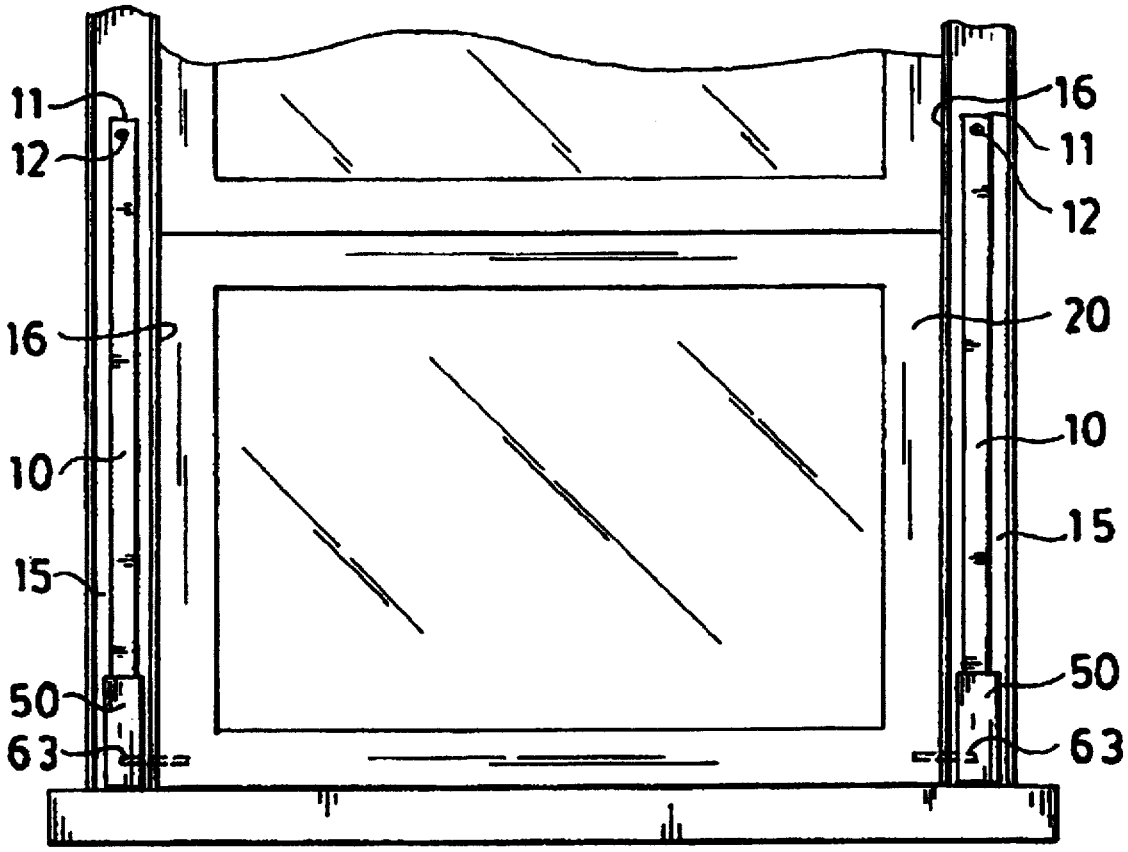

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–63 are confirmed.

* * * * *